US007127023B2

(12) United States Patent
Wieland

(10) Patent No.: US 7,127,023 B2
(45) Date of Patent: Oct. 24, 2006

(54) BATCH TARGET AND METHOD FOR PRODUCING RADIONUCLIDE

(75) Inventor: Bruce W. Wieland, Chapel Hill, NC (US)

(73) Assignee: Duke University, Durham, NC (US)

( * ) Notice: Subject to any disclaimer, the term of this patent is extended or adjusted under 35 U.S.C. 154(b) by 0 days.

(21) Appl. No.: 10/441,818

(22) Filed: May 20, 2003

(65) Prior Publication Data

US 2004/0000637 A1 Jan. 1, 2004

Related U.S. Application Data

(60) Provisional application No. 60/382,224, filed on May 21, 2002, provisional application No. 60/382,226, filed on May 21, 2002.

(51) Int. Cl.
*G21G 1/10* (2006.01)

(52) U.S. Cl. ..... 376/195; 376/189; 376/198; 376/201

(58) Field of Classification Search ..... 376/194, 376/195, 190, 192, 156, 199, 189, 198, 201
See application file for complete search history.

(56) References Cited

U.S. PATENT DOCUMENTS 2,868,987 A * 1/1959 Salsig, Jr. et al. ..... 250/428
3,349,001 A * 10/1967 Myles ..... 376/193
3,966,547 A * 6/1976 Blue ..... 376/192
4,752,432 A 6/1988 Bida et al.
4,818,468 A * 4/1989 Jungerman et al. ..... 376/195
4,990,787 A 2/1991 Vanderheyden et al.
5,280,505 A * 1/1994 Hughey et al. ..... 376/156
5,345,477 A * 9/1994 Wieland et al. ..... 376/195
5,392,319 A * 2/1995 Eggers ..... 376/194
5,425,063 A * 6/1995 Ferrieri et al. ..... 376/195
5,586,153 A 12/1996 Alvord
5,917,874 A * 6/1999 Schlyer et al. ..... 376/194
6,130,926 A 10/2000 Amini
2003/0007588 A1 1/2003 Kiselev et al.

OTHER PUBLICATIONS

Ramaswamy et al., "Performance of a Compact Two-Chamber Two-Phase Thermosyphon: Effect of Evaporator Inclination, Liquid Fill Volume and Contact Resistance", Proceedings of the 11th International Heat Transfer Conference, Kyongju, Korea, vol. 2, pp. 127-132 (1998).

(Continued)

*Primary Examiner*—Ricardo J. Palabrica
(74) *Attorney, Agent, or Firm*—The Eclipse Group LLP; David P. Gloekler

(57) ABSTRACT

An apparatus for producing a radionuclide includes a target chamber including a beam strike region for containing a liquid and a condenser region for containing a vapor. A particle beam source is operatively aligned with the beam strike region, and a lower liquid conduit communicates with the beam strike region. The condenser region is disposed above the beam strike region in fluid communication therewith for receiving heat energy from the beam strike region and transferring condensate to the beam strike region. The lower liquid conduit transfers liquid to and from the beam strike region. In operation, the target chamber acts as a thermosyphon that is self-regulating in response to heat energy deposited by the particle beam source. A portion of the liquid expands into the lower liquid conduit prior to boiling. After boiling begins, a vapor void is created above the liquid and an evaporation/condensation cycle is established, with additional liquid being displaced into the lower liquid conduit.

31 Claims, 4 Drawing Sheets

OTHER PUBLICATIONS

Pal et al., "Design and Performance Evaluation of a Compact Thermosyphon", THERMES 2002, Jan. 13-16, Sante Fe, USA, pp. 251-260 (2002).

Ramaswamy et al., "Thermal Performance of a Compact Two-Phase Thermosyphon: Response to Evaporator Confinement and Transient Loads", J. Enhanced Heat Transfer, vol. 6, No. 2-4, pp. 279-288 (1999).

Beitelmal et al., "Two-Phase Loop: Compact Thermosyphon", HPL-2002-6 (Jan. 11, 2002).

Lock, "The Tubular Thermosyphon: Variations on a Theme", Oxford Engineering Science Series 33, Oxford University Press (1992).

Wieland B. W. and Wolf A. P.; "Large Scale Production And Recovery Of Aqueous F-18 Fluoride Using Proton Bombardment Of A Small vol. 0-18 Water Target", *Journal of Nuclear Medicine*, vol. 24, No. 5, (May 1983) p. 122.

Wieland B. W., "A negative ion cyclotron using 11 MeV protons for the production of radionuclides for clinical positron tomography", in Helus F and Ruth TJ, eds., *Proceedings of the first workshop on targetry and target chemistry* (1985), DKFZ Press, Heidelberg, Germany, 1987, pp. 119-125.

Wieland B. W., Hendry G. O. and Schmidt D. G., "Design and Performance of Targets for Producing C-11, N-13, O-15 and F-18 with 11 MeV Protons", Paper 72, pp. 159-161, 6th Int'l Symposium on Radiopharmaceutical Chemistry, Boston, MA Jun. 29-Jul. 3, 1986, *J Label. Comp. Radiopharm*, 23:1187 (1986).

Wieland B. W., Hendry G. O., Schmidt D. G., Bida G. T. and Ruth T. J., "Efficient Small vol. 0-18 Water Targets for Producing F-18 fluoride with Low Energy Protons", Paper 78, pp. 177-179, 6th Int'l Symposium on Radiopharmaceutical Chemistry, Boston, MA Jun. 29-Jul. 3, 1986, *J Label. Comp. Radiopharm*, 23:1205 (1986).

Wieland B. W., Schmidt D. G., Bida G. T., Ruth T. J. and Hendry G. O., "Efficient Economical Production of Oxygen-15 Labeled Tracers with Low Energy Protons", Paper 82, pp. 186-187, 6th Int'l Symposium on Radiopharmaceutical Chemistry, Boston, MA Jun. 29-Jul. 3, 1986, *J Label. Comp. Radiopharm*, 23:1214 (1986).

Ruth T. J., Helus F. and Wieland B., "A Report on the Heidelberg Targetry Workshop", 6th Int'l Symposium on Radiopharmaceutical Chemistry; Boston, MA Jun. 29-Jul. 3, 1986, Paper 160, pp. 368-369.

Wieland B. W. and Hendry G. O., "Cyclotron Targets for Routine Production of F-18 Fluoride and O-15 oxygen with an 11 MeV Proton Cyclotron", in Ruth TJ, McQuarrie SA and Helus F, eds., *Proceedings of the second workshop on targetry and target chemistry* (*1987*), DKFZ Press, Heidelberg, Germany, 1989, pp. 58-62.

Wieland B. W., Bida G. T., Padgett H. C. and Hendry G. O., "Current Status of CTI Target Systems for the Production of PET Radiochemicals", in Ruth TJ, ed., *Proceedings of the third workshop on targetry and target chemistry* (*1989*), TRIUMF Press, Vancouver, 1990, pp. 34-48.

Harris C. C., Need J. L., Dew V. D., Dailey M. F., Coleman R. E., Padgett H. C. and Wieland B. W., "Successful Production of F-18 Fluorodeoxyglucose Using F-18 Ion Produced in an Nickel-Plated Copper Target", in *Proceedings of the third workshop on targetry and target chemistry* (*1989*), TRIUMF Press, Vancouver, 1990, p. 66.

Wieland B. W., Alvord C. W., Bida G. T. and Hendry G. O., "New Liquid Target Systems for the Production of [Fluorine-18]Fluoride Ion and [Nitrogen-13]Ammonium Ion with 11 MeV Protons", *Targetry '91, proceedings of the fourth workshop on targetry and target chemistry*, Villigen, Switzerland, PSI Proceedings 92-01 (Aug. 1992), pp. 117-122.

Wieland B. W., McKinney C. J. and Dailey M. F., "Utilization of the CS-30 Cyclotron at the Duke University Medical Center", in *Proceedings of the fifth int'l workshop on targetry and target chemistry* (Sep. 19 to 23, 1993) at Brookhaven National Laboratory and Northshore University Hospital, Long Island, NY, BNL-61149 (1995), p. 359.

Wieland, B., Illan C., Doster M., Roberts A., Runkle R., Rowland C. and Bida J., "Self-Regulating Thermosyphon Water Target for Production of F-18-Fluoride at Proton Beam Power of One kW and Beyond", *Proceedings of the Ninth International Workshop on Targetry and Target Chemistry*, Turku, Finland, (May 23-25, 2002), pp. 19-20.

Wieland B. and Wright B., Regenerative Turbine Pump Recirculating Water Target for Producing F-18-Fluoride Ion with Several kW Proton Beams, *Proceedings of the Ninth International Workshop on Targetry and Target Chemistry*, Turku, Finland, (May 23-25, 2002), pp. 21-22.

Wieland B. W., Wright B. C., Bida G. T., Illan C. D., Doster J. M., Clark J. C. and Runkle R. C., "Thermosyphon Batch and Regenerative Turbine Recirculating $_{18}O(p,n)^{18}F$ Water Targets for Operation at High Beam Power", *10th Workshop on Targetry and Target Chemsitry*, Madison, Wisconsin (Aug. 13-15, 2004), p. 26.

* cited by examiner

BATCH TARGET AND METHOD FOR PRODUCING RADIONUCLIDE

RELATED APPLICATIONS

This application claims the benefit of U.S. Provisional Patent Application Ser. Nos. 60/382,224 and 60/382,226, both filed May 21, 2002; the disclosures of which are incorporated herein by reference in their entireties.

TECHNICAL FIELD

The present invention relates generally to radionuclide production. More specifically, the invention relates to apparatus and methods for producing a radionuclide such as F-18 using a thermosyphonic beam strike target.

BACKGROUND ART

Radionuclides such as F-18, N-13, O-15, and C-11 can be produced by a variety of techniques and for a variety of purposes. An increasingly important radionuclide is the F-18 ($^{18}F^-$) ion, which has a half-life of 109.8 minutes. F-18 is typically produced by operating a cyclotron to proton-bombard stable O-18 enriched water ($H_2{}^{18}O$), according to the nuclear reaction $^{18}O(p,n)^{18}F$. After bombardment, the F-18 can be recovered from the water. For at least the past two decades, F-18 has been produced for use in the chemical synthesis of the radiopharmaceutical fluorodeoxyglucose (2-fluoro-2-deoxy-D-glucose, or FDG), a radioactive sugar. FDG is used in positron emission tomography (PET) scanning. PET is utilized in nuclear medicine as a metabolic imaging modality employed to diagnose, stage, and restage several cancer types. These cancer types include those for which the Medicare program currently provides reimbursement for treatment thereof, such as lung (non-small cell/SPN), colorectal, melanoma, lymphoma, head and neck (excluding brain and thyroid), esophageal, and breast malignancies. When FDG is administered to a patient, typically by intravenous means, the F-18 label decays through the emission of positrons. The positrons collide with electrons and are annihilated via matter-antimatter interaction to produce gamma rays. A PET scanning device can detect these gamma rays and generate a diagnostically viable image useful for planning surgery, chemotherapy, or radiotherapy treatment.

It is estimated that the cost to provide a typical FDG dose is about 30% of the cost to perform a PET scan, and the cost to produce F-18 is about 66% of the cost to provide the FDG dose derived therefrom. Thus, according to this estimate, the cyclotron operation represents about 20% of the cost of the PET scan. If the cost of F-18 could be lowered by a factor of two, the cost of PET scans would be reduced by 10%. Considering that about 350,000 PET scans are performed per year, this cost reduction could potentially result in annual savings of tens of millions of dollars. Thus, any improvement in F-18 production techniques that results in greater efficiency or otherwise lowers costs is highly desirable and the subject of ongoing research efforts.

At the present time, about half of the accelerators such as cyclotrons employed in the production of F-18 are located at commercial distribution centers, and the other half are located in hospitals. The full production potential of these accelerators is not realized, at least in part because current target system technology cannot dissipate the heat that would be produced were the full available beam current to be used. About one of every 2,000 protons stopping in the target water produces the desired nuclear reaction, and the rest of the protons simply deposit heat. It is this heat that limits the amount of radioactive product that can be produced in a given amount of time. State-of-the-art target water volumes are typically about 1–3 $cm^3$, and typically can handle up to about 500 W of beam power. In a few cases, up to 800 W of beam power has been attained. Commercially available cyclotrons capable of providing 10–20 MeV proton beam energy, are actually capable of delivering twice the beam power that their respective targets are able to safely dissipate. It is proposed herein that, in comparison to conventional targets, if target system technology could be developed so as to tolerate increased beam power by a factor or two or more, the production of F-18 could at the least be potentially doubled, and the above-estimated cost savings could be realized.

In most conventional batch target systems, a target volume includes a metal window on its front side in alignment with a proton beam source, and typically is partially filled with target water from the bottom thereof to a level at or above that of the beam strike. If beam power were applied to a completely filled conventional target, boiling in the target volume would cause a very rapid rise in pressure due to the sudden appearance of vapor bubbles. As a result, target pressure will dramatically increase, thereby causing the window to plastically deform until it ruptures or otherwise fails. Thus, the conventional target is typically incompletely filled and sealed such that the mass of water therein is fixed. As a result, the conventional target is limited to a single optimum beam power level that prevents destruction, and this optimum power level does not correspond to the most efficient production of radionuclides for the given target system and beam source and for all beam power levels. In addition, because the bottom of the conventional target is sealed, the target water expands upwardly when heated into a reflux chamber, thereby reducing the vapor space available for heat transfer. Moreover, such conventional targets have the disadvantage of introducing pressurizing gas molecules other than water vapor into the target volume, which can be potentially contaminating and which impedes heat transfer efficiency.

An opposite approach to reducing the cost of F-18 production is to use a low-energy (8 MeV), high current (100–150 mA) proton beam, as disclosed in U.S. Pat. No. 5,917,874. A cooled target volume is connected to a top conduit and a bottom conduit. A front side of the target is defined by a thin (6 μm) foil window aligned with the proton beam generated by a cyclotron. The window is supported by a perforated grid for protection against the high pressure and heat resulting from the proton beam. The target volume is sized to enable its entire contents to be irradiated. A sample of O-18 enriched water to be irradiated is injected into the target volume through the top conduit instead of from the bottom. The resulting F-18 is discharged through the bottom conduit by supplying helium through the top conduit. Such target systems as disclosed in U.S. Pat. No. 5,917,874, deliberately designed for use in conjunction with a low-power beam source, cannot take advantage of the full power available from commercially available high-power beam sources.

It would therefore be advantageous to provide a new batch target device and associated radionuclide production apparatus and method that are compatible with the full range of beam power commercially available and are characterized by improved efficiencies, performance and radionuclide yield.

SUMMARY OF THE INVENTION

According to one embodiment, an apparatus for producing a radionuclide comprises a target chamber, a particle beam source, and a lower liquid conduit. The target chamber comprises a beam strike region for containing a liquid and a condenser region for containing a vapor. The condenser region is disposed above the beam strike region in fluid communication therewith for receiving heat energy from the beam strike region and transferring condensate to the beam strike region. The particle beam source is operatively aligned with the beam strike region for bombarding the beam strike region with a particle beam. The lower liquid conduit fluidly communicates with the beam strike region for transferring liquid to and from the beam strike region during bombardment.

A method is disclosed herein for producing a radionuclide, according to the following steps. A target chamber is filled with a target fluid including a target material. The target chamber is pressurized. A lower region of the target chamber is bombarded with a particle beam. The target fluid becomes heated and expands into a lower liquid conduit communicating with the lower region, and a vapor space is created in an upper region of the target chamber contiguous with the lower region to establish a self-regulating evaporation/condensation cycle.

It is therefore an object of the invention to provide an apparatus and method for producing a radionuclide.

An object of the invention having been stated hereinabove, and which is addressed in whole or in part by the present disclosure, other objects will become evident as the description proceeds when taken in connection with the accompanying drawings as best described hereinbelow.

DETAILED DESCRIPTION OF THE INVENTION

As used herein, the term "target material" means any suitable material with which a target fluid can be enriched to enable transport of the target material, and which, when irritated by a particle beam, reacts to produce a desired radionuclide. One non-limiting example of a target material is $^{18}O$ (oxygen-18 or O-18), which can be carried in a target fluid such as water ($H_2\ ^{18}O$). When O-18 is irradiated by a suitable particle beam such as proton beam, O-18 reacts to produce the radionuclide $^{18}F$ (fluorine-18 or F-18) according to the nuclear reaction O-18(P,N)F-18 or, in equivalent notation, $^{18}O(p,n)^{18}F$.

As used herein, the term "target fluid" generally means any suitable flowable medium that can be enriched by, or otherwise be capable of transporting, a target material or a radionuclide. One non-limiting example of a target fluid is water.

As used herein, the term "fluid" generally means any flowable medium such as liquid, gas, vapor, supercritical fluid, or combinations thereof.

As used herein, the term "liquid" can include a liquid medium in which a gas is dissolved and/or a bubble is present.

As used herein, the term "vapor" generally means any fluid that can move and expand without restriction except for a physical boundary such as a surface or wall, and thus can include a gas phase, a gas phase in combination with a liquid phase such as a droplet (e.g., steam), supercritical fluid, or the like.

Figure 1:
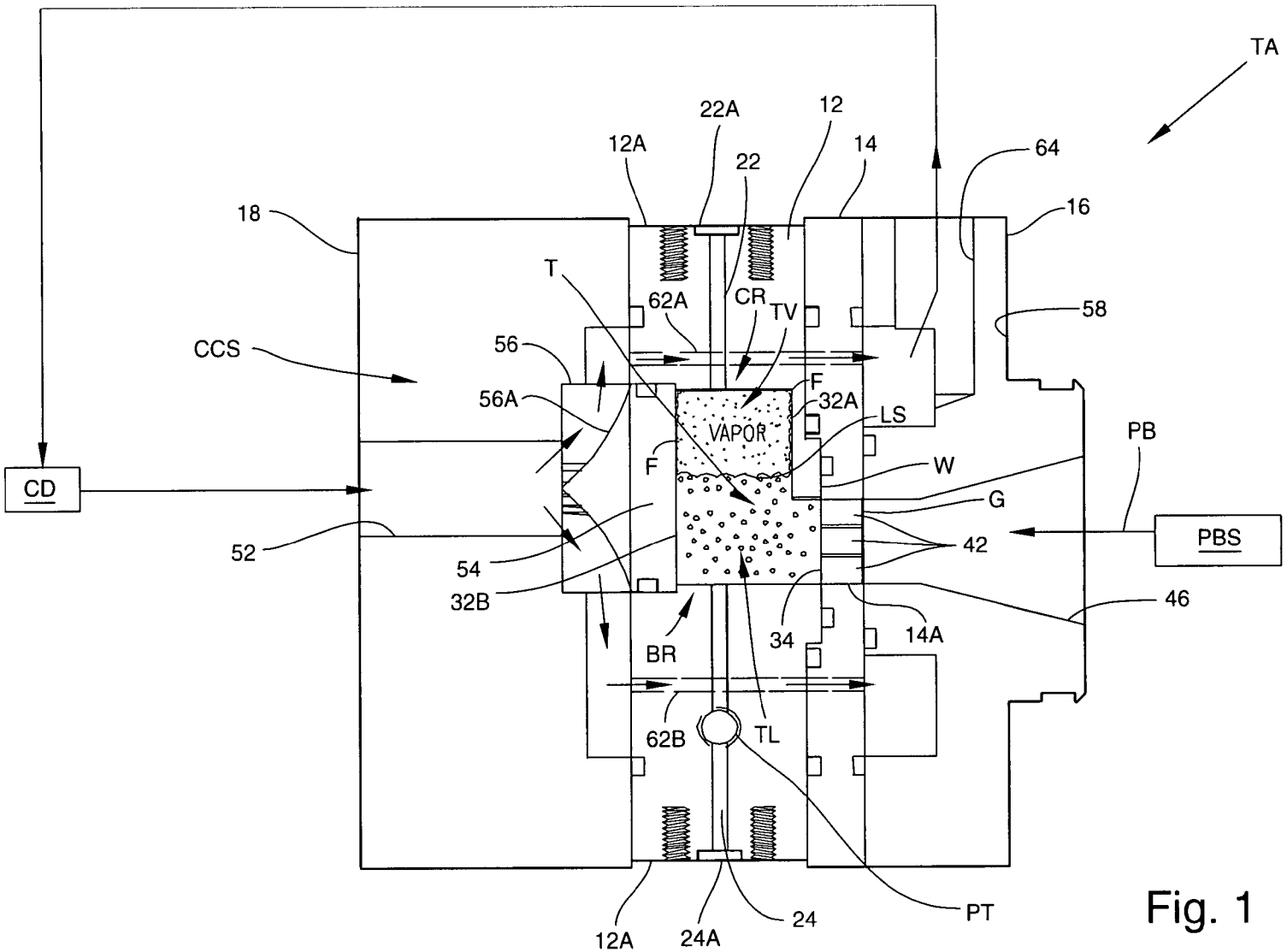
FIG. 1 is a cross-sectional side elevation view of a target assembly provided in accordance with an embodiment disclosed herein.

Referring now to, FIG. 1, a target device or assembly, generally designated TA, is illustrated in accordance with an exemplary embodiment. Target assembly TA generally comprises a target body 12, a window body or flange 14 secured to the front side (beam input side) of target body 12, a front body or flange 16 secured to the front side of window flange 14, and a back body or flange 18 secured to the back side of target body 12. As appreciated by persons skilled in the art, the various body or flange sections of target assembly TA can be secured to each other by any suitable means, such as by using appropriate fastening members such as threaded bolts.

Figure 2:
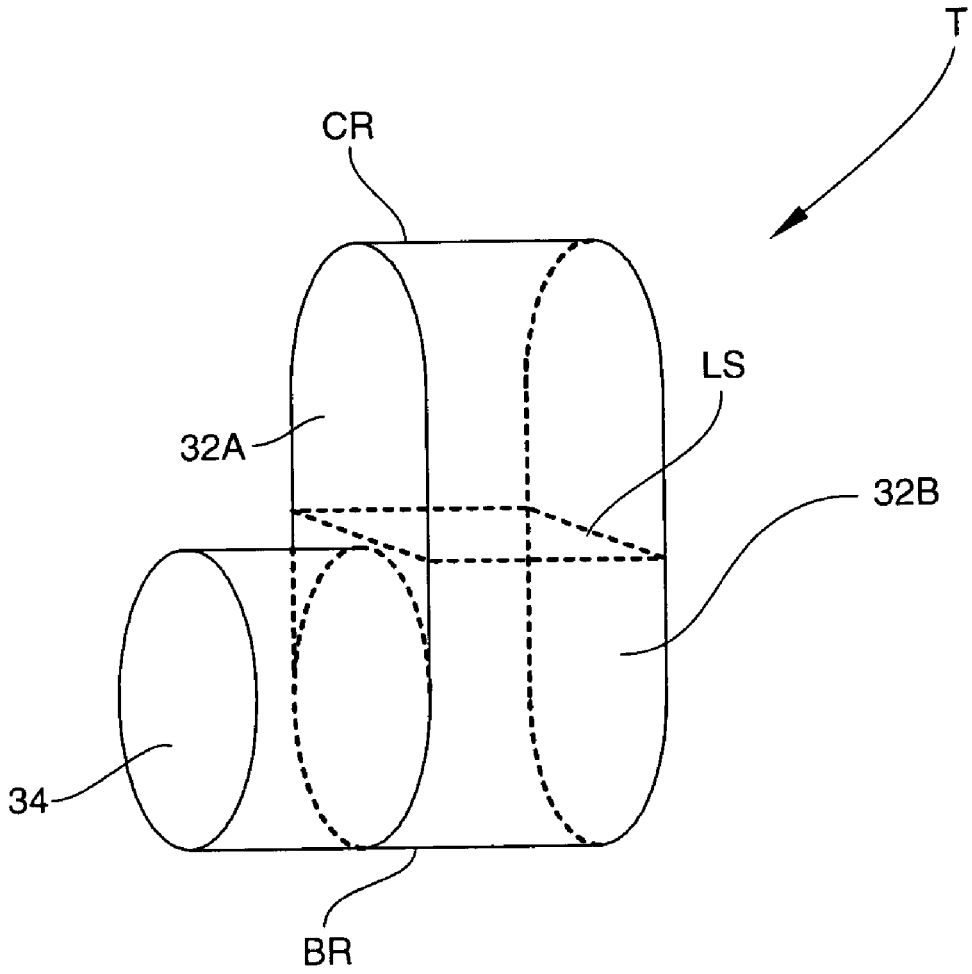
FIG. 2 is a perspective view of a target chamber provided with the target assembly.

Target body 12 in one non-limiting example is constructed from silver. Other suitable non-limiting examples of materials for target body 12 include nickel, titanium, copper, gold, platinum, tantalum, and niobium. Target body 12 defines or has formed in its structure a target chamber, generally designated T; an upper target conduit (or upper liquid conduit, upper fluid conduit, or upper conduit) 22 fluidly communicating with target chamber T; an upper target port 22A generally disposed at an outer surface 12A of target body 12 and fluidly communicating with upper target conduit 22; a lower target conduit (or lower liquid conduit, lower fluid conduit, or lower conduit) 24 fluidly communicating with target chamber T; and a lower target port 24A generally disposed at outer surface 12A of target body 12 and fluidly communicating with lower target conduit 24. As also shown in FIG. 2, in one exemplary embodiment, target chamber T has a generally L-shaped cross-sectional volume between a target front side 32A and a target back side 32B thereof. The lower leg of this L-shape terminates at a beam strike section 34 of target front side 32A for receiving a particle beam PB (FIG. 1).

Figure 4:
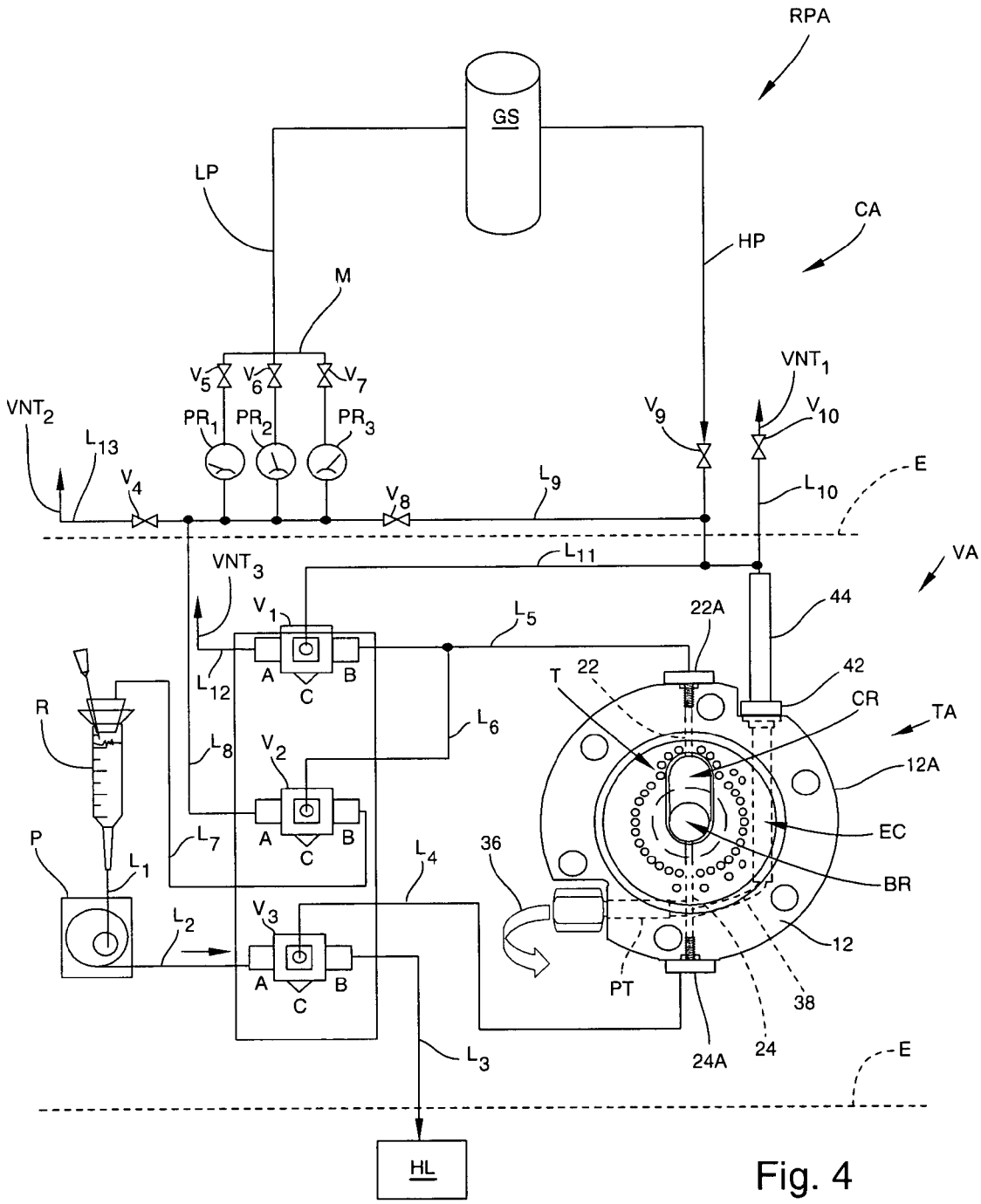
FIG. 4 is a schematic view of a radionuclide production apparatus provided in accordance with an embodiment disclosed herein.

Some additional details of target body 12 are shown in the partially schematic view of FIG. 4, which illustrates target body 12 from its front side. A pressure transducer PT is installed in a bore 34 of target body 12 in fluid communication with lower target conduit 24 and in electrical communication with an electrical cable 36 for sending pressure measurement signals to reading instrumentation external to target body 12. This fitting 36 is suitable for connection to a pressure transducer, as schematically represented by an arrow PT. A fluid passage 38 interconnects lower target conduit 24 with an expansion chamber EC. Expansion chamber EC fluidly communicates with a fitting 42 mounted externally to target body 12, to which an extension 44 of expansion chamber EC can be connected.

As further shown in FIGS. 1 and 2, in the operation of target chamber T, the interior of target chamber T is virtually partitioned into a boiler or evaporator region (also termed a beam strike region or, more generally, a lower region), generally designated BR, and a condenser region (or more generally, an upper region), generally designated CR. Condenser region CR is disposed above, but is contiguous with, boiler region BR. Boiler region BR fluidly communicates with lower target conduit 24, and condenser region CR fluidly communicates with upper target conduit 22. During operation of target assembly TA, as described in more detail hereinbelow, boiler region BR is generally defined by a volume of target liquid, generally designated TL (i.e., liquid-phase target fluid), residing in target chamber T, and condenser region CR is generally defined by a void or space containing target vapor, generally designated TV, above target liquid TL. The virtual partition or boundary between boiler region BR and condenser region CR is thus generally defined by a liquid surface LS of target liquid TL present in target chamber T at any given time. Target liquid surface LS is schematically depicted by a shaded area in FIG. 2. Due to the thermodynamics occurring within target chamber T during operation, the level or elevation of target liquid surface LS is variable. Owing to the variable or virtual partitioning of target chamber T into boiler region BR and condenser region CR, target chamber T can be characterized as a thermosyphon.

The thermosyphonic design of target chamber T illustrated herein, however, is unlike most conventional thermosyphons. As appreciated by persons skilled in the art, a conventional thermosyphon typically includes physically distinct upper and lower chambers serving as a condenser and a boiler, respectively, which usually are fluidly interconnected by a liquid line and a vapor line. By contrast, the thermosyphonic design of target chamber T disclosed herein comprises condenser region CR that is physically contiguous with or adjoined to boiler region BR, and thus does not require liquid and vapor lines. Moreover, unlike other conventional thermosyphons and heat pipes that have an essentially single interior volume, target chamber T includes lower target conduit 24 that allows liquid to shift in and out of target chamber T in response to cooling and heating, respectively. Conventional thermosyphons are described in, for example, Lock, G. S. H., The Tubular Thermosyphon, Oxford University Press (1992); Ramaswamy et al., "Performance of a Compact Two-Chamber Two-Phase Thermosyphon: Effect of Evaporator Inclination, Liquid Fill Volume and Contact Resistance", Proceedings of the 11$^{th}$ International Heat Transfer Conference, Volume 2, Pages 127–132 (1998); Joshi et al., "Design and Performance Evaluation of a Compact Thermosyphon", THERMES 2002, Pages 251–260 "Pages 1–10" (2002); Ramaswamy et al., "Thermal Performance of a Compact Two-Phase Thermosyphon: Response to Evaporator Confinement and Transient Loads", J. Enhanced Heat Transfer, Volume 6, Number 2–4, Pages 279–288 (1999); and Beitelmal et al., "Two-Phase Loop: Compact Thermosyphon", Hewlett Packard Company, Pages 1–22 (2002).

In one exemplary embodiment, the internal volume provided by target chamber T can range from approximately 1.5 to approximately 5.0 cm$^3$, and the diameter of beam strike section 34 can range from approximately 0.8 to approximately 1.8 cm$^3$. In one exemplary embodiment, during the operation of target assembly TA, the volume of condenser region CR can range from approximately 0.8 to approximately 2.5 cm$^3$, and the ratio of the respective volumes of condenser region CR to boiler region BR can range from approximately 0.5:1 to approximately 2:1.

As shown in FIG. 1, a target window W is interposed between target body 12 and window flange 14 and defines beam strike section 34 of target chamber T. Target window W can be constructed from any material suitable for transmitting a particle beam PB while minimizing loss of beam energy. A non-limiting example is a metal alloy such as the commercially available HAVAR® alloy, although other metals such as titanium, tantalum, tungsten, gold, and alloys thereof could be employed. Another purpose of target window W is to demarcate and maintain the pressurized environment within target chamber T and the vacuum environment through which particle beam PB is introduced to target chamber T at beam strike section 34. The thickness of target window W is preferably quite small so as not to degrade beam energy, and thus can range, for example, between approximately 0.3 and 30 μm. In one exemplary embodiment, the thickness of target window W is approximately 25 μm.

Figure 3:
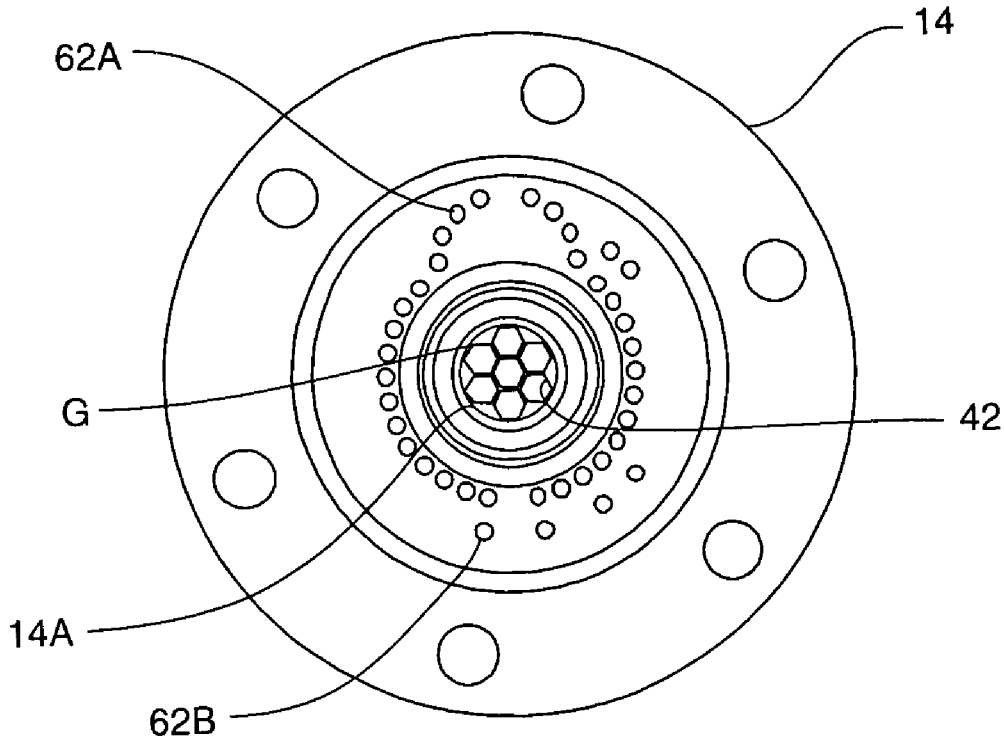
FIG. 3 is a front elevation view of a target window flange provided with the target assembly.

Referring now to FIGS. 1 and 3, window flange 14 in one non-limiting example is constructed from aluminum. Other suitable non-limiting examples of materials for window flange 14 include gold, copper, titanium, and tantalum. Window flange 14 defines a window bore 14A generally aligned with target window W and beam strike section 34 of target chamber T. In one advantageous embodiment, a window grid G is mounted within window bore 14A and abuts target window W. Window grid G is useful in embodiments where target window W has a small thickness and therefore is subject to possible buckling or rupture in response to fluid pressure developed within target chamber T. Window grid G can have any design suitable for adding structural strength to target window W and thus preventing structural failure of target window W. In one embodiment, window grid G is a grid of thin-walled tubular structures adjoined in a pattern so as to afford structural strength while not appreciably interfering with the path of particle beam PB. In the advantageous embodiment illustrated in FIGS. 1 and 3, window grid G comprises a plurality (e.g., seven, or more or less) of hexagonal or honeycomb-shaped tubes 42. In one embodiment, the depth of window grid G along the axial direction of beam travel can range from approximately 1 to approximately 4 mm, and the width between the flats of each hexagonal tube 42 can range from approximately 1 to approximately 4 mm. In other embodiments, additional strength is not needed for target window W and thus window grid G is not used.

Referring again to FIG. 1, front flange 16 in one non-limiting example is constructed from aluminum. Other suitable non-limiting examples of materials for front flange 16 include copper and stainless steel. Back flange 18 likewise can be constructed from aluminum or other suitable materials as previously described. Front flange 16 defines a particle beam introduction bore 46 generally aligned with window grid G, target window W and beam strike section 34 of target chamber T. A particle beam source PBS of any suitable design is provided in operational alignment with particle beam introduction bore 46. The particular type of particle beam source PBS employed in conjunction with the embodiments disclosed herein will depend on a number of factors, such as the beam power contemplated and the type of radionuclide to be produced. For example, to produce the $^{18}F^-$ ion according to the nuclear reaction $^{18}O(p,n)^{18}F$, a proton beam source is particularly advantageous. Generally, for a beam power ranging up to approximately 1.5 kW (for example, a 100-μA current of protons driven at an energy of 15 MeV), a cyclotron or linear accelerator (LINAC) is typically used for the proton beam source. For a beam power typically ranging from approximately 1.5 kW to 10.0 kW (for example, 0.1–1.0 mA of 15 MeV protons), a cyclotron or LINAC adapted for higher power is typically used for the proton beam source. For the thermosyphonic target chamber T specifically disclosed herein, a cyclotron or LINAC operating in the range up to 1.5 kW is recommended for use as particle beam source PBS.

As further shown in FIG. 1, target assembly TA includes a coolant circulation device or system, generally designated CCS, for transporting any suitable heat transfer medium such as water through various structural sections of target assembly TA. A primary purpose of coolant circulation system CCS is to enable heat energy transferred into target chamber T via particle beam PB to be carried away from target assembly TA via the circulating coolant. Coolant circulation system CCS can have any design suitable for positioning one or more coolant conduits, and thus the coolant moving therethrough, in thermal contact with one or more inner structures of target assembly TA that define target chamber T. In the illustrated embodiment, coolant circulation system CCS comprises a coolant inlet bore 52 formed in back flange 18; a back plenum 54 formed in back flange 18; a target back structure 56 disposed at an interfacial region of back flange 18 and target body 12; a front plenum 58 formed in front flange 16; one or more coolant passages such as passages 62A and 62B formed through the axial thickness of target body 12 and disposed radially outwardly of target chamber T between back plenum 54 and front plenum 58; and a coolant outlet bore 64 formed in front flange 16. In addition, coolant circulation system CCS fluidly communicates with a cooling device or system CD of any suitable design (including, for example, a motor-powered pump, heat exchanger, condenser, evaporator, and the like). Cooling systems based on the circulation of a heat transfer medium as the working fluid are well-known to persons skilled in the art, and thus cooling device CD need not be further described herein. It can be seen from the various flow path arrows in FIG. 1 that coolant flows from cooling device CD to coolant inlet bore 52, target back structure 56, back plenum 54, coolant passages 62A and 62B and others if provided, front plenum 58, coolant outlet bore 64, and then returns to cooling device CD. Target back structure 56 includes a profiled surface 56A designed to split the flow of incoming coolant to upper and lower sections of target assembly TA and to prevent stagnation of the coolant flow. As shown in FIG. 3, a plurality of coolant passages including passages 62A and 62B can be provided in a pattern designed to optimize heat transfer.

Referring now to FIG. 4, an example of a radionuclide production apparatus or system, generally designated RPA, is schematically illustrated for interacting with target assembly TA. In FIG. 4, the beam side of target assembly TA (i.e., the view of the front side of front side of target body 12) is illustrated. In addition to target assembly TA, radionuclide production apparatus RPA generally comprises an enriched target fluid supply reservoir R; a pump P for transporting the target material carried in a target fluid; and a pressurizing gas supply source GS. Radionuclide production apparatus RPA further comprises various vents $VNT_1$, $VNT_2$, and $VNT_3$ to atmosphere; valves $V_1$–$V_{10}$; pressure regulators $PR_1$, $PR_2$ and $PR_3$; and associated fluid lines $L_1$–$L_{13}$ as appropriate. Although not specifically shown, one or more additional pressure regulators are installed in appropriate gas supply lines to enable pressurized gas supply source GS to deliver a suitable gas at a relatively high pressure (e.g., 500 psig or thereabouts), indicated by a gas line HP, to valve $V_9$, and a suitable gas at a relatively low pressure (e.g., 30 psig or thereabouts), indicated by a gas line LP, to a manifold M and thus valves $V_5$, $V_6$ and $V_7$. A radiation-shielding enclosure E, a portion of which is depicted schematically by dashed lines in FIG. 4, defines a vault area, generally designated VA, which houses the potentially radiation-emitting components of radionuclide production apparatus RPA. On the other side of enclosure E is a console area, generally designated CA, in which the remaining components as well as appropriate operational control devices (not shown) are situated, and which is safe for users of radionuclide production apparatus RPA to occupy during its operation. Also external to vault area VA is a remote, downstream radionuclide collection site or "hot lab" HL, for collecting and/or processing the as-produced radionuclides into radiopharmaceutical compounds for PET or other applications.

Enriched target fluid supply reservoir R can be any structure suitable for containing a target material carried in a target medium, such as the illustrated syringe-type body. Pump P can be of any suitable design, such as a MICRO π-PETTER® precision dispenser available from Fluid Metering, Inc., Syosset, N.Y. Pressurizing gas supply source GS can be any suitable source, such as a tank, compressor, or the like for delivering a suitable gas that is inert to the nuclear reaction producing the desired radionuclide. Non-limiting examples of a suitable pressurizing gas include helium, argon, and nitrogen. In the exemplary embodiment illustrated in FIG. 4, valves $V_1$, $V_2$ and $V_3$ are three-position ball valves actuated by gear motors and are rated at 2500 psig. For each of valves $V_1$, $V_2$ and $V_3$, two ports A and B are alternately open or closed and the remaining port C is blocked. Hence, when both ports A and B are closed, fluid flow through that particular valve $V_1$, $V_2$ or $V_3$ is completely blocked. Remaining valves $V_4$–$V_{10}$ are solenoid-actuated valves. Other types of valve devices could be substituted for any of valves $V_1$–$V_{10}$ as appreciated by persons skilled in the art. Pressure regulators $PR_1$, $PR_2$ and $PR_3$ are set by way of example to 0.5, 5, and 15 psig, respectively, to provide relatively low-, medium-, and high-pressure when desired. Fluid lines $L_1$–$L_{13}$ are sized as appropriate for the target volume to be processed in target chamber T, one example being 1/32 inch I.D. or thereabouts.

The fluid circuitry or plumbing of radionuclide production apparatus RPA according to the embodiment illustrated in FIG. 4 will now be summarized. Fluid line $L_1$ interconnects target material supply reservoir R and the inlet side of pump P for conducting the target fluid enriched with the target material. Fluid line $L_2$ interconnects the outlet side of pump P and port A of valve $V_3$ for delivering the enriched target fluid. Fluid line $L_3$ is a delivery line for delivering as-produced radionuclides to hot lab HL from port B of valve $V_3$. In one embodiment, delivery line $L_3$ is approximately 100 feet in length. Fluid line $L_4$ is a transfer line interconnected between valve $V_3$ and lower target port 24A, for alternately supplying the enriched target fluid to target chamber T or delivering the target fluid carrying the as-produced radionuclides from target chamber T. Fluid line $L_5$ interconnects upper target port 22A and port B of valve $V_1$. In operation, fluid line $L_5$ receives excess target fluid from target chamber T, receives vapor from target chamber T during depressurization, or conducts pressurizing gas to target chamber T from fluid line $L_6$. Fluid line $L_6$ interconnects fluid line $L_5$ and valve $V_2$, and in operation either receives excess target fluid from fluid line $L_5$ or conducts pressurizing gas to fluid line $L_5$. Fluid line $L_7$ interconnects port B of valve $V_2$ and enriched target fluid supply reservoir R, and is primarily used to recirculate enriched target fluid back to supply reservoir R during the loading of target chamber T and thereby sweep away bubbles in the lines.

Continuing with FIG. 4, fluid line $L_8$ interconnects port A of valve $V_2$ and fluid line $L_9$ for conducting pressurizing gas to valve $V_2$. Fluid line $L_9$ includes "T" intersections for fluidly communicating with pressure regulators $PR_1$, $PR_2$ and $PR_3$. Fluid line $L_{10}$ is an expansion or depressurization line interconnecting expansion chamber EC of target assembly TA with vent $VNT_1$, and is employed for gently or slowly depressurizing target chamber T according to a method disclosed herein. For this purpose, in one embodiment, fluid line $L_{10}$ has an inside diameter of 0.010 inch or thereabouts and is 100 feet in length. Fluid line $L_{11}$ interconnects fluid line $L_{10}$ and valve $V_1$ and can conduct pressurizing gas to vent $VNT_1$ through valve $V_1$. A portion of fluid line $L_{11}$ is employed to conduct a pressurizing gas to target chamber T from high-pressure gas line HP. Fluid line $L_{12}$ interconnects port A of valve $V_1$ and vent $VNT_3$. Fluid line $L_{13}$ interconnects valve $V_4$ and vent $VNT_2$. Manifold M interconnects pressurizing gas supply source GS and valves $V_5$, $V_6$ and $V_7$ for selectively conducting pressurizing gas from pressurizing gas supply source GS to fluid lines $L_9$ and $L_8$ through pressure regulator $PR_1$, $PR_2$ or $PR_3$.

The following four Tables provide the control sequences and ON/OFF states of valves $V_1$–$V_{10}$ and pump P during load, beam run, delivery, and standby steps, respectively, which occur during the operation of radionuclide production apparatus RPA. In each step, components are turned ON in the order shown. In the case of multi-port valves $V_1$–$V_3$, the specific port A or B of that valve $V_1$, $V_2$ or $V_3$ that is open is indicated. It will be noted that for each event listed, those valves $V_1$–$V_{10}$ and pump P not specifically listed are in their OFF positions. All components are turned OFF between steps. Finally, as appreciated by persons skilled in the art, time delays and pressure interlocks are variables that can be determined for specific applications of radionuclide production apparatus RPA.

TABLE 1

LOAD TARGET MATERIAL SEQUENCE

| COMPONENTS ON | EVENT |
|---|---|
| $V_4$, $V_2$-A, $V_1$-B | Vent to atmosphere. |
| $V_2$-B, $V_3$-A, P | Pump target fluid up through target. |

TABLE 2

RUN BEAM SEQUENCE

| COMPONENTS ON | EVENT |
|---|---|
| $V_9$ | Pressurize target.<br>Leak check. |
| $V_9$ | Beam on target, then beam off at end.<br>Leak check. |

TABLE 3

DELIVERY SEQUENCE

| COMPONENTS ON | EVENT |
|---|---|
| $V_1$-B, $V_{10}$ | Equalize pressure, slow depressurize. |
| $V_1$-B, $V_8$, $V_4$ | Vent to atmosphere. |
| $V_3$-B | Gravity drain into delivery line. |
| $V_3$-B, $V_2$-A | Low pressure on upper target port. |
| $V_3$-B, $V_8$, $V_5$ | Low pressure on expansion chamber top. |
| $V_3$-B, $V_1$-B, $V_2$-A, $V_6$ | Medium pressure delivery. |
| $V_3$-B, $V_1$-B, $V_2$-A, $V_7$ | High pressure delivery. |

TABLE 4

STANDBY AFTER DELIVERY COMPLETE

| COMPONENTS ON | EVENT |
|---|---|
| $V_4$, $V_2$-A, $V_1$-B | Vent to atmosphere, then all off. |

The operation of target assembly TA and radionuclide production apparatus RPA will now be described, with primary reference being made to FIGS. 1 and 4 and Tables 1–4. As indicated by the Tables hereinabove, the method can generally be divided into four main steps or sequences of steps: (1) loading enriched target fluid into target chamber T, (2) applying a particle beam to target chamber T, (3) delivering the resultant radionuclide to a downstream site such as hot lab HL, and (4) initiating a post-delivery standby procedure.

In preparation of radionuclide production apparatus RPA and its target assembly TA for the loading of target chamber T and subsequent beam strike, the fluidic system is vented to atmosphere by opening valve $V_4$, port A of valve $V_2$, and port B of valve $V_1$. Also, a target fluid enriched with a desired target material is loaded into reservoir R, or a pre-loaded reservoir R is connected with fluid lines $L_1$ and $L_7$. Port B of valve $V_2$ and port A of valve $V_3$ are then opened, thereby establishing a closed loop through pump P, valve $V_3$, target chamber T, valve $V_2$, and reservoir R. Pump P is then activated, whereupon the enriched target fluid is transported to target chamber T via lower target conduit 24, completely filling target chamber T (in effect, both boiler region BR and condenser region CR) from the bottom. During the loading of target chamber T, the enriched target fluid is permitted to fill upper target conduit 22 and flow back through valve $V_2$ and reservoir R, ensuring that any bubbles in the closed loop are swept away. Once charged in this manner, target chamber T is effectively sealed off at the top by closing port B of valve $V_2$.

Target chamber T is pressurized from the bottom by opening valve $V_9$ and delivering a high-pressure gas through expansion chamber EC, fluid passage 38, and lower target conduit 24. A system leak check can then be performed by any suitable technique known to persons skilled in the art. At this stage, target chamber T is ready to receive particle beam PB. Particle beam source PBS (FIG. 1) is then operated to emit a particle beam PB through particle beam introduction bore 46, the openings defined by window grid G, and target window W at beam strike section 34 of target chamber T in alignment with boiler region BR.

Irradiation by particle beam PB of enriched target liquid TL (FIG. 1) in target chamber T causes heat energy to be transferred to target liquid TL, thereby initiating a thermosyphonic evaporation/condensation cycle within target chamber T. Due to the presence of lower target conduit 24 and the fact that the top of target chamber T and its upper target conduit 22 are effectively sealed, the heating of target liquid TL causes thermal expansion of target liquid TL into lower target conduit 24. Thus, some of target liquid TL is forced out of the bottom of target chamber T into cooled lower target conduit 24 and expansion chamber EC prior to the onset of boiling, against the pressure head maintained by the pressurizing gas supplied to target assembly TA. As shown in FIG. 1, sufficient heat is added to boil target liquid TL in target chamber T, thereby forming bubbles that rise due to buoyancy effects. These events create a vapor void or space in the upper confines of target chamber T, thereby defining a condenser region CR above, yet contiguous with, a generally distinct boiler region BR in target chamber T. As described previously, boiler region BR and condenser region CR are generally demarcated by a liquid surface LS (FIG. 1). As heating increases, condenser region CR enlarges, and the vapor therein condenses on those portions of the metal surfaces of target chamber T that are exposed to the vapor space. The resulting liquid-phase droplets and/or films F then run down the exposed surfaces to return to the liquid-phase volume contained in boiler region BR.

It can thus be seen that target chamber T, operating as a thermosyphon, drives an evaporation/condensation cycle that is very efficient and self-regulating. At low beam power, target chamber T is completely or nearly filled with liquid-phase target fluid, and heat transfer occurs by way of natural convection cooling patterns. As the beam power increases, target chamber T self-regulates the cycle by increasing the vapor space until there is adequate condenser surface area to remove the excess heat energy introduced by particle beam PB. The process is quite dynamic at high beam power, with target fluid constantly cycling in and out at the bottom of target chamber T and moving up and down in expansion chamber EC. Target chamber T reaches the limit of its performance when sufficient beam power is applied to allow the vapor space to lower liquid surface LS toward the point where particle beam PB starts passing through vapor at the top of the beam strike area and into target back structure 56. The vapor in expansion chamber EC then starts to oscillate up and down, breaking up the target fluid column therein into gas/liquid interfaces. The self-regulating performance and depth of target chamber T prevent particle beam PB from ever passing through to target back structure 56, which is undesirable from a radionuclide production standpoint. If target chamber T is operated at any point below this maximum power limit, and particle beam PB is then removed or its intensity reduced, the target fluid cools rapidly, the vapor condenses, and target chamber T again becomes filled to the top with liquid-phase target fluid as the contents of expansion chamber EC flow back through lower target port 24A (the original condition). The size of condenser vapor volume is thus maintained in proportion to the beam power. Moreover, foreign gas molecules impeding target vapor transport are avoided.

In the operation of thermosyphonic target chamber T, an important consideration is the depth (the dimension from its front side to back side) of target chamber T. The depth of target chamber T should be sufficient to accommodate density reduction due to the vapor bubbles generated in and rising up through the beam strike due to boiling at any power level. Calorimetry data has been acquired in the course of experimental testing of prototypes of target assembly TA disclosed herein, using the CS-30 cyclotron at Duke University, Durham, N.C. The measurements indicated that a linear increase of target depth is required to compensate for vapor bubble density reduction with increasing beam current. For example, for 22 MeV protons on 30 atm water, the target depth required increased from 5 mm at 10 μA where boiling just begins, to 10 mm at 40 μA. The beam generated by the CS-30 cyclotron is quite concentrated, about 3–4 mm at full width half-maximum (FWHM). The target depth required for other cyclotrons with other energies and beam optics might vary considerably. The depth required is also a strong function of the ability of a particular target to efficiently remove heat deposited by the beam. Referring to FIG. 2, an exemplary depth through boiler region BR between beam strike section 34 and back side 32B of target chamber T can range from approximately 0.2 to 12.0 cm. although the invention is not limited solely to this range.

Calorimetry data was also studied to assess heat removal partitioning between target back structure 56, target body 12, and the collimator/degrader typically provided with particle beam source PBS. These calorimetry data were compared to the power deposited as calculated from the product of beam current and beam energy. The latter data were higher than the calorimetry data, which suggests that some heat is also removed by natural convection and radiation from the target flange components in addition to the forced convection cooling. In all cases, the heat removal by the target sides and condenser region CR was about four times that removed by target back structure 56.

The nuclear effect of particle beam PB irradiating the enriched target fluid in target chamber T is to cause the target material in target fluid to be converted to a desired radionuclide material in accordance with an appropriate nuclear reaction, the exact nature of which depends on the type of target material and particle beam PB selected. Examples of target materials, target fluids, radionuclides, and nuclear reactions are provided hereinbelow. Particle beam PB is run long enough to ensure a sufficient or desired amount of radionuclide material has been produced in target chamber T, and then is shut off. A system leak check can then be performed at this time.

Once the radionuclides have been produced and particle beam source PBS is deactivated, radionuclide production apparatus RPA is taken through pressure equalization and depressurization procedures to gently or slowly depressurize target chamber T in preparation for delivery of the radionuclides to hot lab HL. These procedures are designed to be gentle or slow enough to prevent any pressurizing gas that is dissolved in the target fluid from escaping the liquid-phase too rapidly and causing unwanted perturbation of the target fluid. First, port B of valve $V_1$ and valve $V_{10}$ are opened to allow vapor to vent to atmosphere via depressurization line $L_{10}$ and vent $VNT_1$. In one advantageous embodiment, depressurization line $L_{10}$ has a smaller inside diameter than the other fluid lines in the system, and is relatively long (e.g., 0.010 inch I.D., 100 feet). While port B of valve $V_1$ remains open, valve $V_{10}$ is closed and valves $V_8$ and $V_4$ are opened to allow vapor to vent to atmosphere via vent $VNT_2$.

After equalization and depressurization, port B of valve $V_3$ is opened to establish fluid communication between target chamber T at its lower target conduit 24 and lower target port 24A and an appropriate downstream site such as hot lab HL, and to initiate a gravity drain into delivery line $L_3$. A sequence of pressurizing steps is then performed to cause the target fluid and radionuclides in target chamber T to be delivered through lower target conduit 24, target fluid transfer line $L_4$, valve $V_3$ and delivery line $L_3$ to hot lab HL for collection and/or further processing. Port A of valve $V_2$ is opened to establish fluid communication between fluid line $L_8$ and upper target port 22A, such that a low pressure is applied to upper target port 22A. Valves $V_8$ and $V_5$ are then opened to apply a low pressure to the top of expansion chamber EC, as regulated by first pressure regulator $PR_1$ (e.g., 0.5 psig or thereabouts). Port A of valve $V_1$ is then re-opened and valve $V_6$ is opened to apply a medium pressure to the top of expansion chamber EC, as regulated by second pressure regulator $PR_2$ (e.g., 5 psig or thereabouts). Valve $V_7$ is then opened to apply a higher pressure to the top of expansion chamber EC, as regulated by third pressure regulator $PR_3$ (e.g., 15 psig or thereabouts).

After delivery of the as-produced radionuclides is completed, radionuclide production apparatus RPA can be switched to a standby mode in which the fluidic system is vented to atmosphere by opening valve $V_4$, port A of valve $V_2$, and port B of valve $V_1$. At this stage, reservoir R can be reloaded with an enriched target fluid or replaced with a new pre-loaded reservoir R in preparation for one or more additional production runs. Otherwise, all valves $V_1$–$V_{10}$ and other components of radionuclide production apparatus RPA can be shut off.

The radionuclide production method just described can be implemented to produce any radionuclide for which use of target assembly TA is beneficial. One example is the production of the radionuclide F-18 from the target material O-18 according to the nuclear reaction O-18(P,N)F-18. Once produced in target chamber T, the F-18 can be transported over delivery line $L_3$ to hot lab HL, where it is used to synthesize the F-18 labeled radiopharmaceutical fluorodeoxyglucose (FDG). The FDG can then be used in PET scans or other appropriate procedures according to known techniques. It will be understood, however, that radionuclide production apparatus RPA could be used to produce other desirable radionuclides. One additional example is $^{13}N$ produced from natural water according to the nuclear reaction $^{16}O(p,\alpha)^{13}N$ or, equivalently, $H_2{}^{16}O(p,\alpha)^{13}\ NH_4{}^+$.

It will be understood that various details of the invention may be changed without departing from the scope of the invention. Furthermore, the foregoing description is for the purpose of illustration only, and not for the purpose of limitation, as the invention is defined by the claims as set forth hereinafter.

What is claimed is:

1. A radionuclide producing apparatus, comprising:

(a) a target chamber comprising a beam strike region for containing a target liquid, a target chamber lower opening communicating with the beam strike region, a condenser region for containing a vapor, and a sealable top above the condenser region, the condenser region disposed above the beam strike region in fluid communication therewith for receiving heat energy from the beam strike region and transferring condensate to the beam strike region;

(b) a particle beam source operatively aligned with the beam strike region for bombarding the beam strike region with a particle beam;

(c) a target liquid expansion chamber including an expansion chamber upper opening and an expansion chamber lower opening, the expansion chamber openly fluidly communicating with the beam strike region via the expansion chamber lower opening and the target chamber lower opening;

(d) a pressurizing gas supply source separate from the target chamber and fluidly communicating with the expansion chamber upper opening; and (e) a lower liquid conduit interposed between the target chamber lower opening and the expansion chamber lower opening and forming an open target liquid flow path between the target chamber and the expansion chamber, wherein the expansion chamber, the lower liquid conduit, and the beam strike region are pressurized by the gas supply source.

2. The apparatus according to claim 1 comprising a cooling device disposed in thermal contact with the target chamber.

3. The apparatus according to claim 2 comprising a body defining the target chamber, wherein the cooling device comprises a coolant conduit farmed in the body and disposed in thermal contact with the target chamber.

4. The apparatus according to claim 1 wherein the target chamber encloses an internal volume ranging from approximately 0.5 to approximately 5.0 $cm^3$.

5. The apparatus according to claim 1 wherein the target chamber comprises a front side and a back side, and a depth between the front and back sides through the beam strike region ranges from approximately 0.2 to approximately 12.0 cm.

6. The apparatus according to claim 1 wherein the condenser region is contiguously disposed above the beam strike region.

7. The apparatus according to claim 1 wherein the condenser region and the beam strike region have respective internal volumes, and the ratio of the condenser region internal volume to the beam strike region internal volume ranges from approximately 0.5:1 to approximately 2:1.

8. The apparatus according to claim 1 comprising an upper liquid conduit fluidly communicating with the condenser region.

9. The apparatus according to claim 8 comprising a target material supply source fluidly communicating with the upper liquid conduit and the target chamber lower opening to form a target material fluid circuit including the target material supply source and the target chamber.

10. The apparatus according to claim 1 comprising a target material supply source adapted for fluid communication with the target chamber lower opening.

11. The apparatus according to claim 10 wherein the target material supply source comprises an oxygen-18 enriched target fluid source.

12. The apparatus according to claim 11 wherein the target fluid source comprises a water source.

13. The apparatus according to claim 1 wherein the particle beam source comprises a proton beam source.

14. The apparatus according to claim 13 wherein the proton beam source comprises a cyclotron.

15. The apparatus according to claim 13 wherein the proton beam source comprises a linear accelerator.

16. The apparatus according to claim 1 comprising a radionuclide delivery line communicating with the target chamber lower opening.

17. The apparatus according to claim 1 wherein the target chamber comprises a front side and a back side, and a depth between the front and back sides through the beam strike region is greater than a depth between the front and back sides through the condenser region.

18. The apparatus according to claim 8 comprising a valve fluidly communicating with the upper liquid conduit and closable for sealing the target chamber.

19. A radionuclide producing apparatus, comprising:

(a) a target chamber comprising an upper section, an upper opening communicating with the upper section, a lower section below the upper section, and a target chamber lower opening communicating with the lower section;

(b) means for applying a particle beam to the target chamber for irradiating target material in the target chamber;

(c) means for applying pressure to the target chamber at the target chamber lower opening during application of the particle beam; and (d) means for providing a target liquid flow path through the target chamber lower opening such that during application of the particle beam target material flows out from the target chamber via the target chamber lower opening against the pressure and back into the target chamber via the target chamber lower opening.

20. The apparatus according to claim 19 comprising means for filling the target chamber via the target chamber lower opening with a target material.

21. The apparatus according to claim 20 wherein the filling means comprises a pump communicating with the target chamber via the target chamber lower opening.

22. The apparatus according to claim 20 comprising an upper conduit communicating with the upper section via the upper opening, and means for sealing the upper conduit.

23. The apparatus according to claim 20 wherein the filling means comprises a target material supply source communicating with the target chamber via the target chamber lower opening.

24. The apparatus according to claim 23 wherein the target material supply source comprises an oxygen-18 enriched target fluid source.

25. The apparatus according to claim 19 wherein the pressure applying means comprises a gas supply source communicating with the target chamber via the target chamber lower opening.

26. The apparatus according to claim 19 wherein the flow path providing means comprises an expansion chamber communicating with the target chamber via the target chamber lower opening.

27. The apparatus according to claim 26 wherein the pressure applying means comprises a gas supply source communicating with the target chamber via the expansion chamber.

28. The apparatus according to claim 1 wherein a volume of target liquid extends into the target liquid expansion chamber, through the target chamber lower opening, and into the target chamber.

29. The apparatus according to claim 19 comprising a closed upper conduit communicating with the upper section via the upper opening, and wherein a volume of liquid-phase target material is disposed in the lower section and a volume of vapor-phase target material is disposed in the upper section.

30. The apparatus according to claim 27 comprising means for filling the target chamber via the target chamber lower opening with target material.

31. The apparatus according to claim 19 wherein the flow path providing means comprises an expansion chamber and a lower liquid conduit, the expansion chamber has an expansion chamber upper opening and an expansion chamber lower opening, the lower liquid conduit interconnects the expansion chamber lower opening and the target chamber lower opening, and the pressure applying means communicates with the expansion chamber upper opening.

* * * * *